US010893742B1

(12) United States Patent
Spiegel

(10) Patent No.: US 10,893,742 B1
(45) Date of Patent: Jan. 19, 2021

(54) DEVICE FOR HOLDING A PHONE

(71) Applicant: H. Jay Spiegel, Mount Vernon, VA (US)

(72) Inventor: H. Jay Spiegel, Mount Vernon, VA (US)

( * ) Notice: Subject to any disclaimer, the term of this patent is extended or adjusted under 35 U.S.C. 154(b) by 0 days.

(21) Appl. No.: 16/779,832

(22) Filed: Feb. 3, 2020

(51) Int. Cl.
*A45F 5/00* (2006.01)

(52) U.S. Cl.
CPC ..... *A45F 5/00* (2013.01); *A45F 2005/008* (2013.01); *A45F 2200/0516* (2013.01)

(58) Field of Classification Search
CPC ..... A45F 5/00; A45F 2005/008; A45F 2200/0516
See application file for complete search history.

(56) References Cited

U.S. PATENT DOCUMENTS 4,821,932 A 4/1989 Petryshyn
5,263,423 A 11/1993 Anderson
6,029,938 A * 2/2000 Fava ..... A45F 5/00 108/43
6,050,201 A 4/2000 Blanchard et al.
6,520,394 B2 2/2003 Ulibarri
9,027,807 B2 5/2015 Kampas
9,316,345 B2 * 4/2016 Tarnay ..... F16M 13/022
9,470,356 B1 * 10/2016 Zaloom ..... A47B 23/04
9,551,459 B2 1/2017 Heyen
2007/0034753 A1 * 2/2007 Lee ..... B60R 11/0241 248/121
2009/0060473 A1 * 3/2009 Kohte ..... F16M 11/041 386/200
2010/0133268 A1 6/2010 Miller
2012/0152990 A1 6/2012 Kulas
2013/0299652 A1 * 11/2013 Graham ..... F16M 11/041 248/205.1
2015/0351531 A1 * 12/2015 Dalton ..... F16M 11/14 248/558
2015/0358044 A1 * 12/2015 Barstead ..... H04B 1/3888 455/575.1
2018/0321573 A1 * 11/2018 Prichard ..... F16M 11/2078

* cited by examiner

*Primary Examiner* — Corey N Skurdal
(74) *Attorney, Agent, or Firm* — H. Jay Spiegel

(57) ABSTRACT

A clip may be placed over the thigh of a driver. At the top of the clip, a bracket assembly is provided. The bracket assembly includes, in the preferred embodiment, a telescoping rod attached to the clip via a ball and socket joint allowing pivoting of the telescoping rod in all directions. On top of the telescoping rod, a cross-shaped phone holder is provided with arms configured to hold a smart phone or cell phone.

20 Claims, 8 Drawing Sheets

DEVICE FOR HOLDING A PHONE

BACKGROUND OF THE INVENTION

The present invention relates to an improved device for holding a phone. In recent times, State legislatures have passed laws forbidding drivers of vehicles from holding a cell phone or smart phone in their hand while the vehicle they are driving is moving. Devices such as "Blue Tooth" are provided in many vehicles which allow hands-free use of a phone. Some drivers do, in fact, still like to have their phone in close proximity so that they can view the display while they are driving.

One example of a reason why vehicle drivers like to have their phone in close proximity is so that they can monitor websites such as "WAZE®" which monitor road conditions and permit one to be made aware of various issues such as presence of police officers, accidents, debris in the road, etc. The "WAZE®" app also allows a user to program their phone to keep them on a route where they are driving, providing information such as a map display, a line showing where they are driving, speed limit and speed information, time left until reaching destination, address information, and other criteria as well as information concerning road conditions and even weather conditions.

As such, a need has arisen for a way to allow a phone to be located in close proximity to a driver without violating regulations and laws forbidding holding of a phone in one's hand while a vehicle is moving. It is with these thoughts in mind that the present invention was developed.

The following prior art is known to Applicant:

U.S. Pat. No. 4,821,932 to Petryshyn discloses a holder for shoe polish cans that includes a strap fastened about the thigh of a seated person and a round cup-like device sized to receive a shoe polish can. The present invention differs from the teachings of Petryshyn as contemplating a cell phone holder attachable over the thigh of a driver and having a holder specific for a cell phone or smart phone.

U.S. Pat. No. 5,263,423 to Anderson discloses an article securement device designed to support a laptop computer on the thigh of the user. The device includes an arcuate member sitting on the thigh and having a flat surface on top to support the laptop computer. The present invention differs from the teachings of Anderson as contemplating a cell phone holder attachable over the thigh of a driver and having a holder specific for a cell phone or smart phone.

U.S. Pat. No. 6,029,938 to Fava discloses a body-attached cup holder including a device attached over the thigh of the wearer and having a cup-like receptacle designed to hold a drink container. The present differs from the teachings of Fava as contemplating a cell phone holder attachable over the thigh of a driver and having a holder specific for a cell phone or smart phone.

U.S. Pat. No. 6,050,201 to Blanchard et al. discloses a swiveling automotive kneeboard which includes a strap that is attachable over a user's thigh and has a kneeboard connected to it with a writing plate. The present invention differs from the teachings of Blanchard et al. as contemplating a cell phone holder attachable over the thigh of a driver and having a holder specific for a cell phone or smart phone.

U.S. Pat. No. 6,520,394 to Ulibarri discloses a pilot pad including straps connected over the thigh of the wearer and supporting a pad including a plurality of sheets. The present invention differs from the teachings of Ulibarri as contemplating a cell phone holder attachable over the thigh of a driver and having a holder specific for a cell phone or smart phone.

U.S. Pat. No. 9,027,807 to Kampas discloses a wearable beverage container holder that is attachable over the thigh or lower leg of the wearer and includes a receptacle for a cup and an elongated slot to support a phone. The present invention differs from the teachings of Kampas wherein the phone holder of the present invention allows the phone to be supported horizontally for easy viewing while driving.

U.S. Pat. No. 9,551,459 to Heyen discloses a multifunctional ultraportable support that includes complex structure for supporting devices including a smart phone. The present invention structurally and functionally distinguishes from Heyen.

Published Application No. US 2010/0133268 A1 to Miller discloses a fast food utensil including a device fastened over the thigh of the wearer and supporting a container that includes two chambers for holding food products. The present invention structurally and functionally distinguishes from the teachings of Miller.

Published Application No. 2012/0152990 A1 to Kulas discloses a thigh-mounted device holder which is designed to hold a smart phone on the thigh of the wearer. The present invention structurally distinguishes from the teachings of Kulas.

SUMMARY OF THE INVENTION

The present invention relates to an improved phone holder. The present invention includes the following interrelated objects, aspects and features:

(1) In a first aspect, the present invention contemplates a clip that may easily be flexed outward placed over the thigh of a driver over their pant leg or stocking and flexed back to frictionally attach over the thigh of the user. It may include a plurality of ribs on its inner surfaces that assist in gripping the thigh or apparel of the user.

(2) At the top of the clip, a bracket assembly is provided. The bracket assembly includes, in the preferred embodiment, a telescoping rod attached to the clip via a ball and socket joint allowing pivoting of the telescoping rod in all directions.

(3) On top of the telescoping rod, a cross-shaped phone holder is provided with perpendicular telescoping arms that have upstanding ends sized and configured so that when the telescoping arms are extended to the proper dimensions, a smart phone or cell phone may be supported on the cross-shaped bracket and gripped at its peripheral edges to securely hold the phone in place.

(4) With the inventive improved device mounted over the thigh of the user and a phone suitably attached to the phone holder thereon, the telescoping rod and ball and socket joint may be adjusted so that the phone is supported in a way clearly visible to the driver of a vehicle when he or she glances downward. In this way, the phone can be utilized in a hands-free manner, to allow dialing of outgoing calls, answering incoming calls, accessing websites such as "WAZE®," and weather websites, and generally allowing safe operation of a vehicle while the driver is able to view their phone.

As such, it is a first object of the present invention to provide an improved device for holding a phone.

It is a further object of the present invention to provide such an improved device with a flexible clip that may be installed over the thigh of a user to allow support of a smart phone or cell phone on it.

It is a still further object of the present invention to provide such an improved phone holder including a telescoping rod attached to the clip via a ball and socket joint to allow raising the phone as well as orienting it in a desirable orientation.

It is a still further object of the present invention to provide such an improved phone holder with a cross-shaped phone holder with telescoping arms allowing the bracket to be adjusted to accommodate to cell phones and smart phones of all different sizes and shapes.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
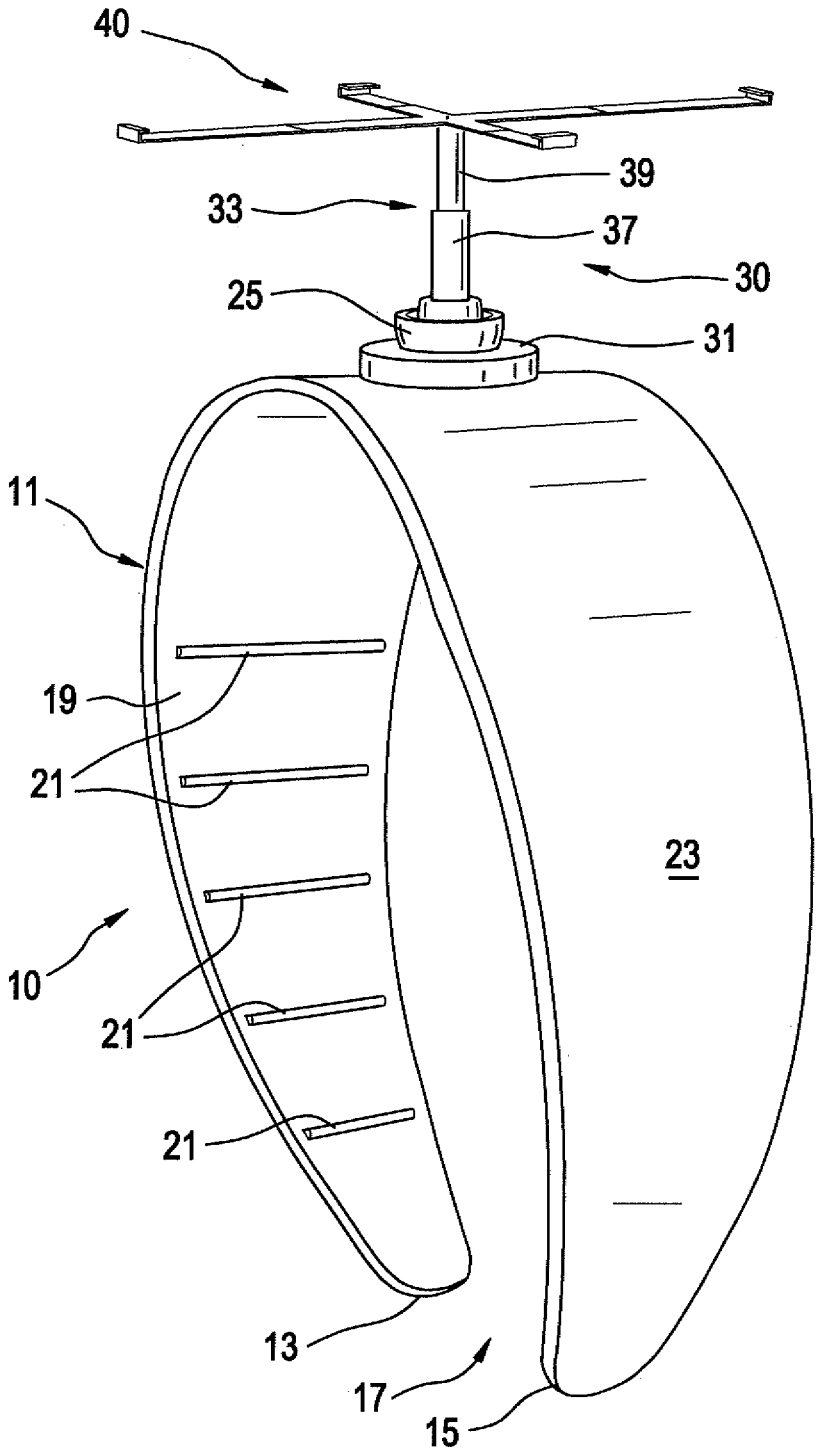
FIG. 1 shows a perspective view of the present invention.
Figure 2:
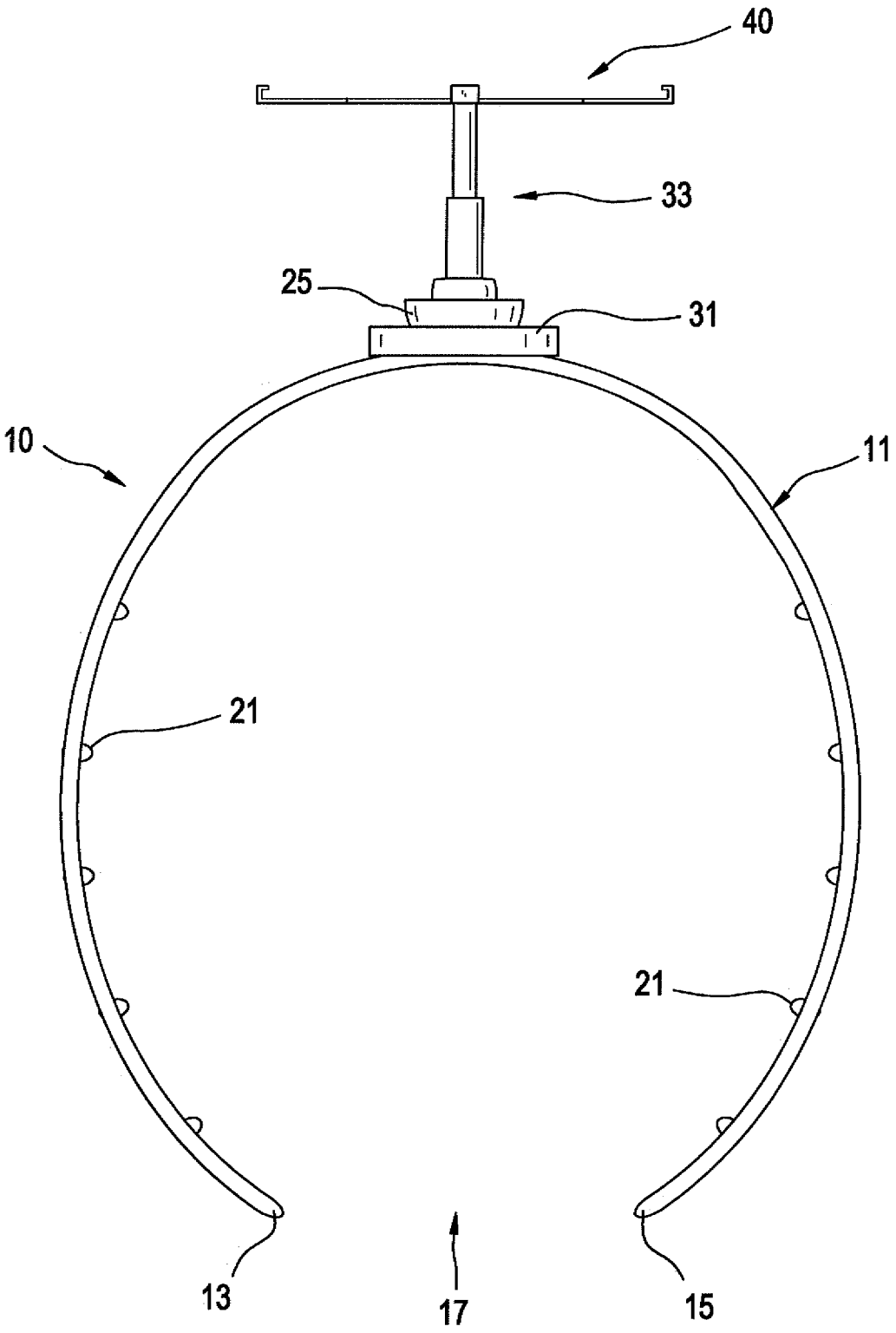
FIG. 2 shows a side view of the present invention.
Figure 3:
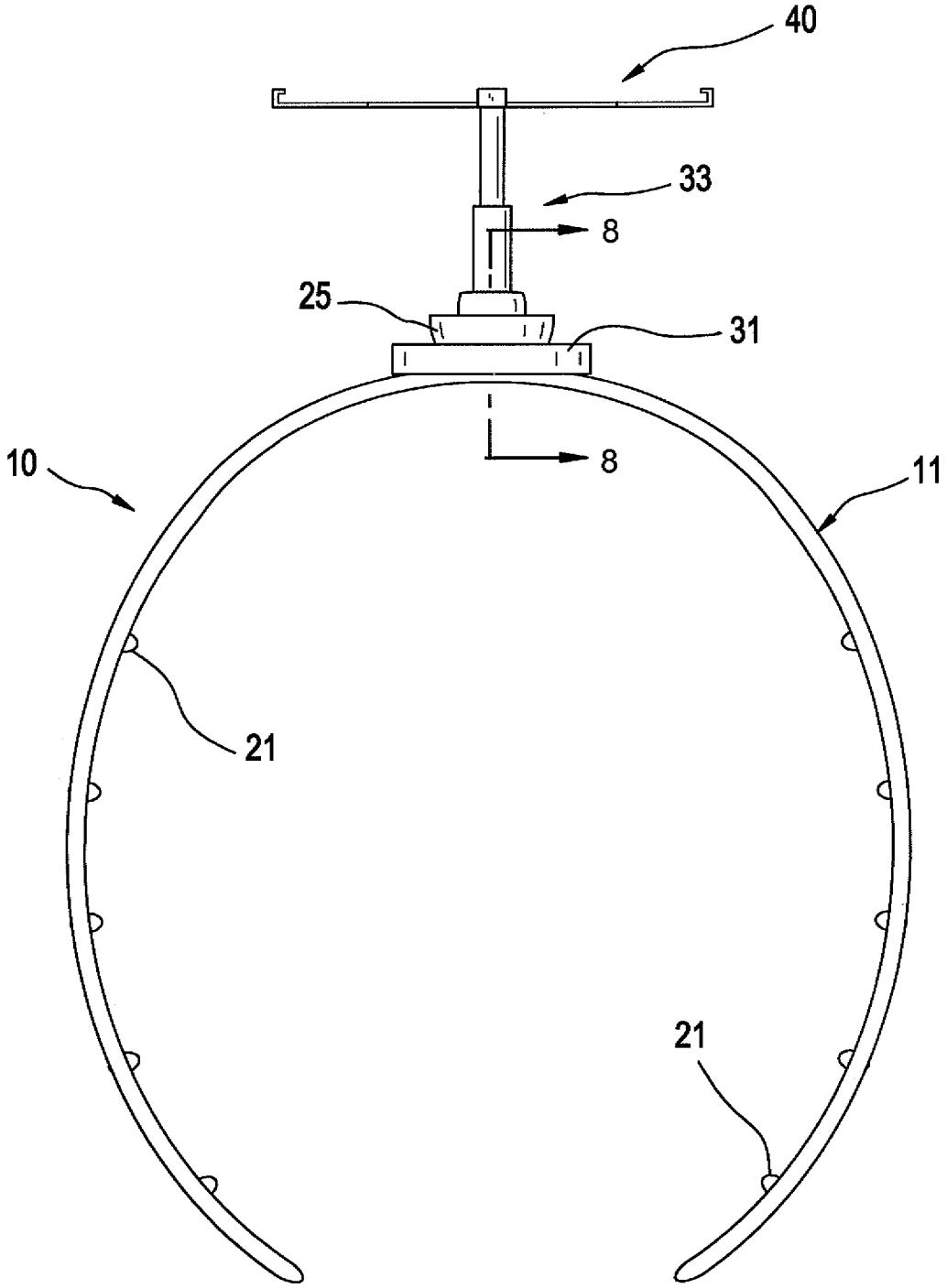
FIG. 3 shows a view similar to FIG. 2 showing a cross-section line.

With reference first to FIGS. 1-6, the present invention is generally designated by the reference numeral 10, and is seen to include a large clip 11 of arcuate shape having ends 13 and 15 facing one another and defining a gap 17 therebetween comprising a relaxed spacing as particularly shown in FIG. 2. The clip 11 is flexible so that it may be flexed to increase the size of the gap 17 toward an expanded spacing to allow it to be placed over the thigh of the user as shown in FIG. 7, typically, in actuality, over a pant leg, stocking, or other leg covering, whereupon the clip 11 snaps back toward its unflexed state or relaxed spacing 17 to grip the thigh over clothing.

The clip 11 has an inner surface 19 which may have a plurality of upstanding ribs 21 on both sides thereof (FIGS. 2-3) which enhance the gripping ability of the clip 11 over the thigh of the wearer.

Figure 8:
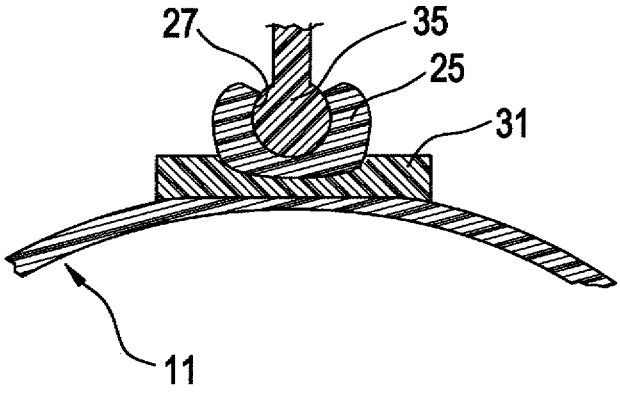
FIG. 8 shows a cross-sectional view along the line 8-8 of FIG. 3.

The clip 11 has an outer surface 23. At the top thereof opposite the gap 17, a bracket assembly 30 is securely mounted. A plate or base 31 is mounted to the surface 23 and supports a receptacle 25 that has a part spherical inner surface 27 (see FIG. 8). Secured within the receptacle 25 and engaging the part spherical surface 27 is a rod generally designated by the reference numeral 33 by virtue of a ball-shaped end 35 (FIG. 8). The surface 27 and ball-shaped end 35 combine to create a ball and socket joint or coupling.

The rod 33 includes a first rod portion 37 which has the ball 35 attached thereto and a second rod portion 39 that telescopes within the rod portion 37 to allow the rod 33 to be extended and contracted as desired. The rod 33 may also be pivoted to any desired orientation based upon interaction between the ball 35 and the surface 27 comprising a socket.

A phone holder 40 is mounted on top of the rod portion 39 and may be mounted so that it may be rotated with respect to the rod portion 39 as desired. Additionally, the rod portion 39 may rotate with respect to the rod portion 37 if desired to allow further adjustability of the position of a smart phone or cell phone.

Figure 4:
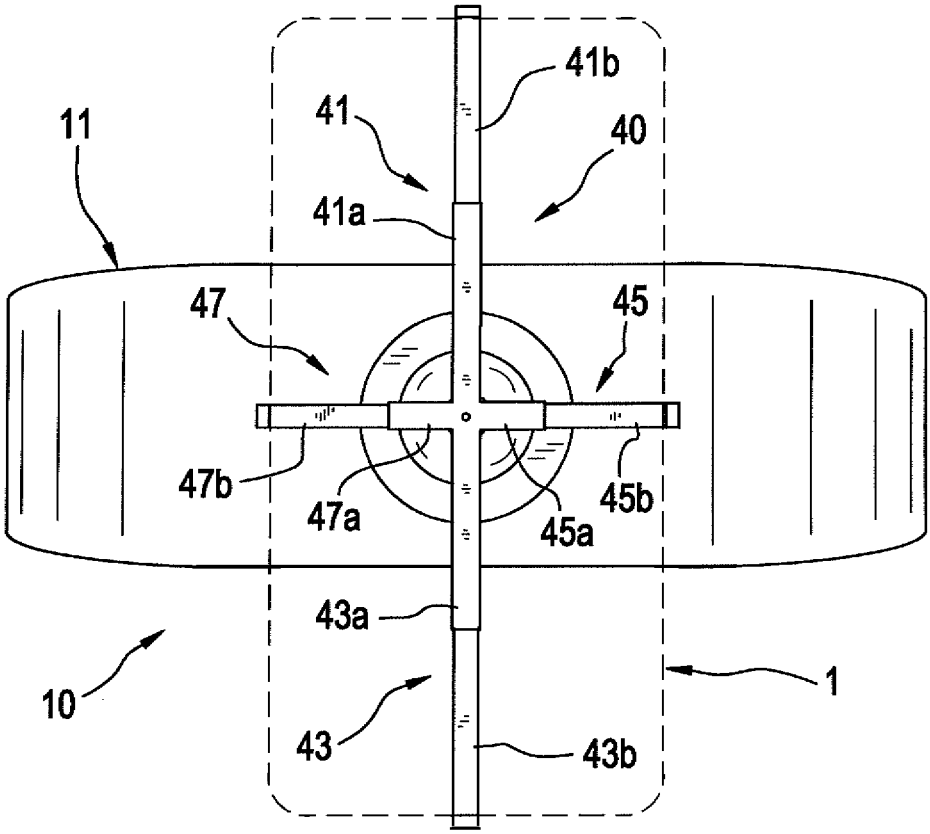
FIG. 4 shows a top view of the present invention.
Figure 5:
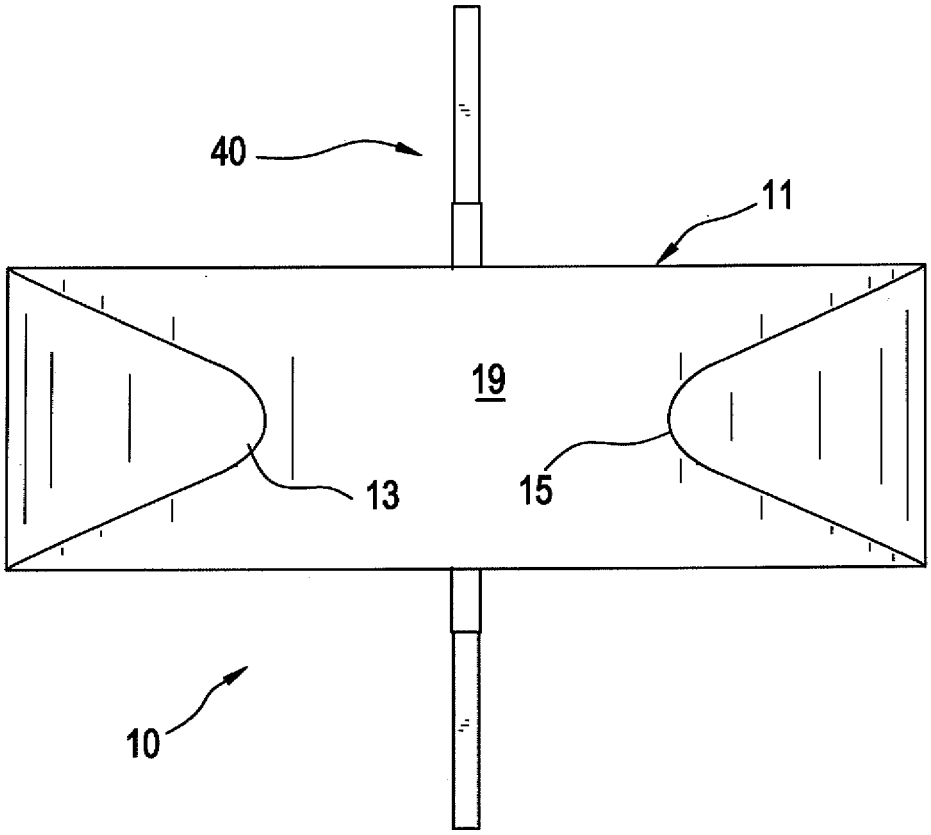
FIG. 5 shows a bottom view of the present invention.

As best seen in FIG. 4, the phone holder 40 is cross-like in shape and includes legs 41, 43, 45 and 47. As seen in FIG. 4, each leg is made of plural leg portions, 41*a*, 41*b*, 43*a*, 43*b*, 45*a*, 45*b* and 47*a*, 47*b*. The legs with the suffix "a" may telescope within the leg portions with the suffix "b" to allow extension and contraction of the legs 41, 43, 45 and 47 to allow adjustability for cell phones and smart phones of various sizes. A phone is shown in phantom in FIG. 4 and designated by the reference numeral 1.

Figure 6:
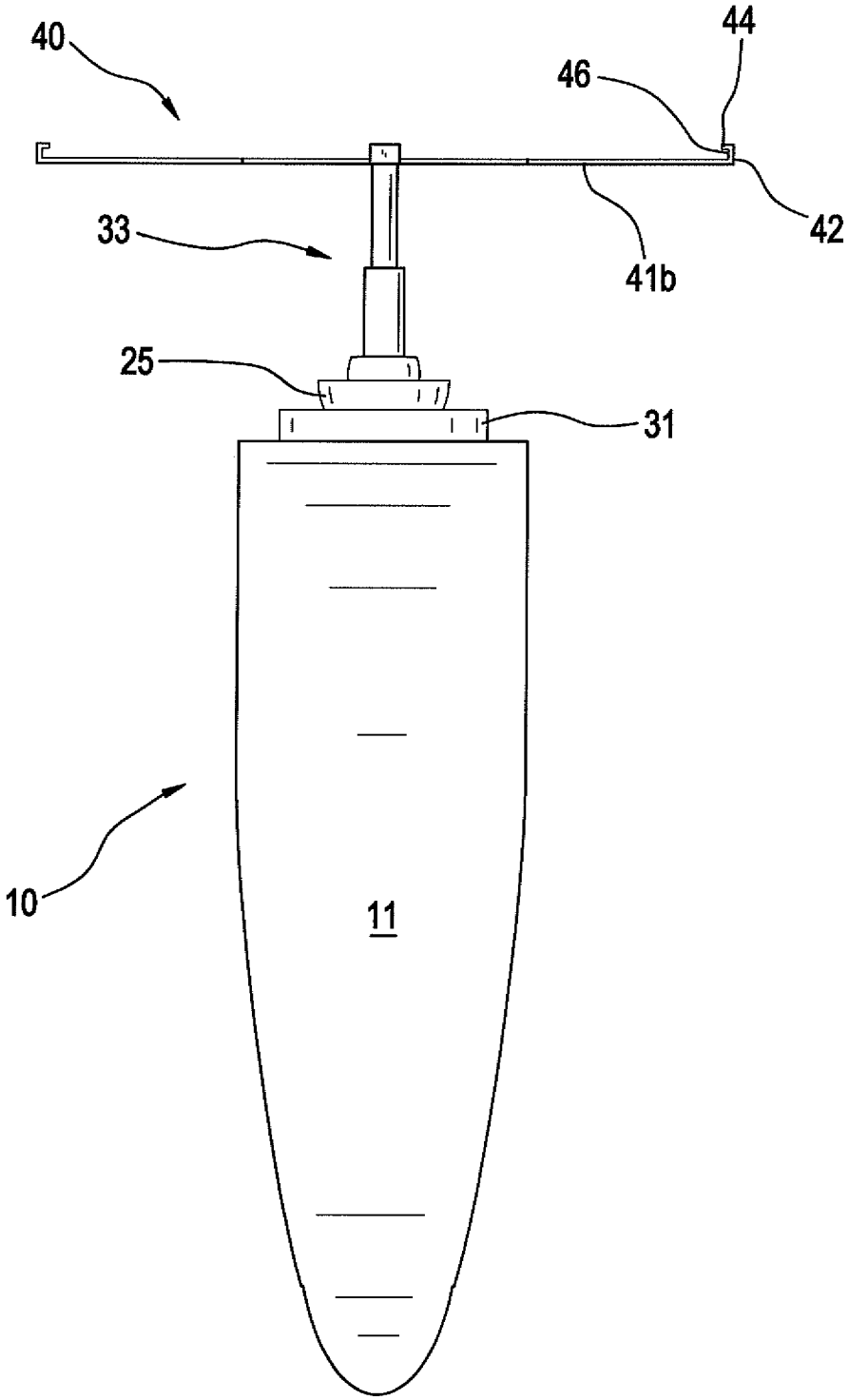
FIG. 6 shows an end view of the present invention.
Figure 7:
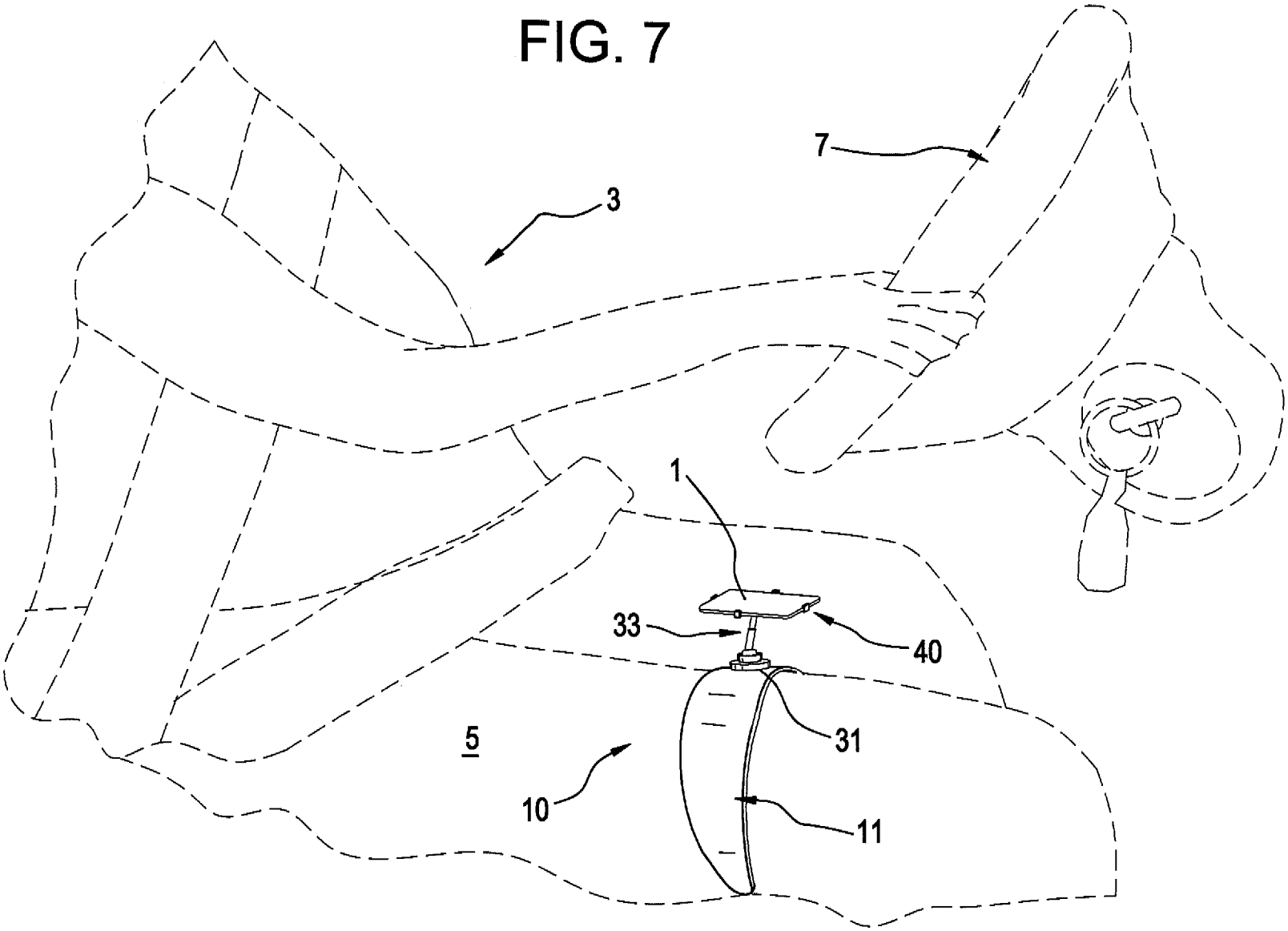
FIG. 7 shows a side perspective view of the present invention with a phone attached thereto and with a driver of a vehicle shown in hatched lines.

With reference to FIGS. 2 and 6 for example, the outer leg portions with the suffix "b" include ends that extend upward and inward to best facilitate gripping a phone supported in the phone holder 40. Thus, for example, with reference to FIG. 6, the leg portion 41*b* has a distal end that extends upward at 42 and then inward at 34 to create a small sub-chamber 46 that allows the leg portion 41*b* to extend over the peripheral edge of the phone to hold it in place. Installation of the phone 1 on the phone holder 40 is easy because the leg portions with the suffix "b" can be extended outward until they create a greater dimension than the corresponding dimension of the phone, whereupon the phone may be placed on top of the bracket and the leg portions retracted until they engage the peripheral edges of the phone to hold it in place.

FIG. 7 shows the inventive device 10 as it is intended to be used. A person 3 has a thigh 5 that is horizontal when the person is sitting in a vehicle seat. The steering wheel is shown by the reference numeral 7.

In the position shown in FIG. 7, the clip 11 may be stretched to expand the opening 17, whereupon it may be placed over the thigh of the user at which point the clip 11 flexes back to grip tightly about the periphery of the thigh or the article of clothing covering the thigh. The cell phone or smart phone 1 is mounted on the phone holder 40 and may be pivoted by operating of the ball and socket joint 27, 35 to adjust the angular pivoted orientation of the phone. The rod 33 may be extended or contracted to the desired extent as desired by the user 3.

In this way, the user may install the device 10 on their thigh, install the phone 1 on the phone holder 40, angulate the phone holder 40 to any desired orientation, pivot the rod 33 to any pivoted position, rotate the phone holder 40 with respect to the rod 33, and thus arrange the phone 1 at any desired position, orientation, and elevation.

In this way, the present invention is quite effective in supporting the phone 1 on the phone holder 40 mounted on the telescoping rod 33 which may be pivoted through operation of the ball and socket joint 35, 27 so that the clip 11 may be mounted over the thigh 5 of the user 3 to provide effective ability of the user 3 to glance down quickly to see the display of the phone 1 without being distracted from driving. In so doing, the user 3 while driving their vehicle will remain in full compliance with applicable laws and regulations concerning driving a moving vehicle without holding a phone in the driver's hand.

The various components of the present invention may be made of suitable plastic, wood, rubber or metal as desired based upon the structure and function thereof. The clip 11 is preferably made of molded plastic or thin flexible metal. The rod 33 and the ball and socket joint 35, 27 are preferably made of metal for strength and durability. The phone holder 40 may be made of any suitable material such as plastic or metal.

The legs 41, 43, 45 and 47 may be oriented and located so that they don't block structures on the periphery of the phone that will be supported by the phone holder 40. Such structures include a speaker, receptacle for recharging plug, and various control buttons.

As such, an invention has been disclosed in terms of a preferred embodiment thereof, which fulfills each and every one of the objects of the invention as set forth hereinabove, and provides a new and useful improved device for holding a phone of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. An improved device for holding a phone, comprising:

a) an arcuate flexible U-shaped clip having ends spaced from one another to define a relaxed spacing therebetween, said ends being flexed to expand said opening to an expanded spacing between said ends to facilitate placing said clip over a thigh of a user, said ends being biased toward said relaxed spacing by flexibility of said clip when said ends are flexed toward said expanded spacing, so that said ends converge toward one another to grip said thigh, said clip having a diameter substantially parallel to said relaxed spacing, said relaxed spacing being shorter than said diameter, said clip being continuous and unitary between said ends;

b) a bracket assembly mounted on said clip comprising:

i) a rigid rod attached to said clip; and ii) a phone holder that is adjustable to securely hold a phone, said phone holder attached to an end of said rod remote from said clip.

2. The improved device of claim 1, wherein said rod is a telescoping rod.

3. The improved device of claim 1, wherein said rod is attached to said clip via a ball and socket joint permitting angular adjustment of said rod with respect to said base.

4. The improved device of claim 3, wherein said rod is a telescoping rod.

5. The improved device of claim 3, wherein said clip is made of flexible plastic.

6. The improved device of claim 3, wherein said phone holder comprises a cross-shaped member.

7. The improved device of claim 1, wherein said phone holder is rotatably connected to said rod.

8. The improved device of claim 1, wherein said phone holder comprises a cross-shaped member.

9. The improved device of claim 8, wherein said cross-shaped member includes four legs.

10. The improved device of claim 9, wherein said legs comprise telescoping legs.

11. The improved device of claim 10, wherein each of said legs has a distal end with an upstanding portion configured to grip a peripheral edge of a phone.

12. The improved device of claim 8, wherein said rod is a telescoping rod.

13. The improved device of claim 1, wherein said clip is made of flexible plastic.

14. The improved device of claim 13, wherein said clip has an inner surface with a plurality of projections for enhancing grip.

15. The improved device of claim 1, wherein a base is interposed between said clip and said rigid rod.

16. An improved device for holding a phone, comprising:

a) an arcuate flexible U-shaped clip having ends spaced from one another to define a relaxed spacing therebetween, said ends being flexed to expand said opening to an expanded spacing between said ends to facilitate placing said clip over a thigh of a user, said ends being biased toward said relaxed spacing by flexibility of said clip when said ends are flexed toward said expanded spacing, so that said ends converge toward one another to grip said thigh, said clip having a diameter substantially parallel to said relaxed spacing, said relaxed spacing being shorter than said diameter, said clip being continuous and unitary between said ends;

b) a bracket assembly mounted on said clip comprising:

i) a base attached to said clip;

ii) a telescoping rod attached to said base with a ball and socket joint; and iii) a cross-shaped phone holder that is adjustable to securely hold a phone, said phone holder attached to an end of said rod remote from said base.

17. The improved device of claim 16, wherein said phone holder is rotatably connected to said rod.

18. The improved device of claim 16, wherein said cross-shaped phone holder includes four legs.

19. The improved device of claim 18, wherein said legs comprise telescoping legs.

20. The improved device of claim 19, wherein each of said legs has a distal end with an upstanding portion configured to grip a peripheral edge of a phone.

* * * * *